US011384405B2

(12) United States Patent
Kela et al.

(10) Patent No.: US 11,384,405 B2
(45) Date of Patent: Jul. 12, 2022

(54) FERRITIC STAINLESS STEEL

(71) Applicant: OUTOKUMPU OYJ, Espoo (FI)

(72) Inventors: Juha Kela, Tornio (FI); Joni Koskiniemi, Kemi (FI); Raimo Levonmaa, Turku (FI)

(73) Assignee: Outokumpu Oyj, Helsinki (FI)

( * ) Notice: Subject to any disclaimer, the term of this patent is extended or adjusted under 35 U.S.C. 154(b) by 0 days.

(21) Appl. No.: 14/442,708

(22) PCT Filed: Nov. 19, 2013

(86) PCT No.: PCT/FI2013/051085

§ 371 (c)(1),
(2) Date: May 13, 2015

(87) PCT Pub. No.: WO2014/080078

PCT Pub. Date: May 30, 2014

(65) Prior Publication Data

US 2016/0281184 A1 Sep. 29, 2016

(30) Foreign Application Priority Data

Nov. 20, 2012 (FI) ..... 20126212

(51) Int. Cl.

| | |
|---|---|
| ***C22C 38/04*** | (2006.01) |
| ***C21C 7/068*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/00*** | (2006.01) |
| ***C22C 38/02*** | (2006.01) |
| ***C22C 38/06*** | (2006.01) |
| ***C22C 38/28*** | (2006.01) |
| ***C22C 38/24*** | (2006.01) |
| ***C22C 38/20*** | (2006.01) |
| ***C22C 38/26*** | (2006.01) |
| *C21D 8/02* | (2006.01) |

(52) U.S. Cl.

CPC ..... *C21C 7/0685* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/24* (2013.01); *C22C 38/26* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C21D 8/0226* (2013.01); *C21D 8/0236* (2013.01); *C21D 8/0263* (2013.01); *C21D 8/0273* (2013.01)

(58) Field of Classification Search

CPC ..... C22C 38/42; C22C 38/44; C22C 38/46; C22C 38/48; C22C 38/50

See application file for complete search history.

(56) References Cited

U.S. PATENT DOCUMENTS

| | | | | |
|---|---|---|---|---|
| 6,113,710 | A * | 9/2000 | Kato | C22C 38/28 148/609 |
| 6,383,309 | B2 * | 5/2002 | Hirata | C21D 6/002 148/325 |
| 7,056,398 | B2 | 6/2006 | Yazawa et al. | |
| 2009/0056838 | A1 | 3/2009 | Ishii et al. | |
| 2011/0110812 | A1 * | 5/2011 | Hiraide | C22C 38/001 420/41 |
| 2011/0176954 | A1 | 7/2011 | Oku et al. | |
| 2013/0129560 | A1 * | 5/2013 | Matsuhashi | C21D 8/0226 420/41 |

FOREIGN PATENT DOCUMENTS

| | | | |
|---|---|---|---|
| AU | 2011286685 | A1 | 2/2013 |
| CN | 101812641 | A | 8/2010 |
| EP | 936280 | A2 | 8/1999 |
| EP | 1715073 | A1 | 10/2006 |
| EP | 1818422 | A1 | 1/2007 |
| EP | 2 100 983 | A1 | 9/2009 |
| EP | 2163658 | A1 | 3/2010 |
| EP | 2182085 | A1 | 5/2010 |
| EP | 2602351 | A1 | 6/2013 |
| JP | S5827962 | A | 2/1983 |
| JP | 2007217716 | A | 8/2007 |

(Continued)

OTHER PUBLICATIONS

International Search Report from corresponding PCT application No. PCT/FI2013/051085, dated Feb. 21, 2014, 4 pgs.

(Continued)

*Primary Examiner* — Jophy S. Koshy
(74) *Attorney, Agent, or Firm* — Quinn IP Law

(57) ABSTRACT

The invention relates to a ferritic stainless steel having excellent corrosion and sheet forming properties. The steel consists of in weight percentages 0.003-0.035% carbon, 0.05-1.0% silicon, 0.1-0.8% manganese, 20-24% chromium, 0.05-0.8% nickel, 0.003-0.5% molybdenum, 0.2-0.8% copper, 0.003-0.05% nitrogen, 0.05-0.8% titanium, 0.05-0.8% niobium, 0.03-0.5% vanadium, less than 0.04% aluminium, and the sum C+N less than 0.06%, the remainder being iron and inevitable impurities in such conditions, that the ratio (Ti+Nb)/(C+N) is higher or equal to 8, and less than 40, and the ratio $Ti_{eq}/C_{eq}$=(Ti+0.515*Nb+0.940*V)/(C+0.858*N) is higher or equal to 6, and less than 40.

12 Claims, No Drawings

(56) References Cited

FOREIGN PATENT DOCUMENTS

| | | | | |
|---|---|---|---|---|
| JP | 2008297631 | A | 12/2008 | |
| JP | 2010100877 | A | 5/2010 | |
| JP | 2012036444 | A | 2/2012 | |
| JP | WO 2012018074 | A1 * | 2/2012 | ..... C21D 8/0226 |
| WO | 2010016014 | A1 | 2/2010 | |
| WO | 2012046879 | A1 | 4/2012 | |

OTHER PUBLICATIONS

Supplementary European Search Report prepared by the European Patent Office for EP 2922978, dated Nov. 13, 2015, 4 pages.
First Office Action and Search Report issued in corresponding Chinese Appl. No 201380060758.8 dated Apr. 7, 2016 (6 pages) along with English translation (6 pages).
Japanese Offiice Action issued in corresponding Appl. No JP 2015-542329 dated Jul. 12, 2016 (7 pages) along with English translation (6 pages).
National Board of Patents and Registration of Finland Search Report issued in corresponding Appl. No. FI 20126212 dated Jul. 30, 2013 (1 page).

* cited by examiner

FERRITIC STAINLESS STEEL

CROSS-REFERENCE TO RELATED APPLICATIONS

This is a national stage application filed under 35 USC 371 based on International Application No. PCT/FI2013/051085 filed Nov. 19, 2013 and claims priority under 35 USC 119 of Finnish Patent Application No. 20126212 filed Nov. 20, 2012.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

This invention relates to a stabilized ferritic stainless steel having good corrosion resistance and good sheet forming properties.

The most critical point in developing ferritic stainless steel is how to take care of carbon and nitrogen elements. These elements have to be bound to carbides, nitrides or carbonitrides. The elements used in this type of binding are called stabilizing elements. The common stabilizing elements are niobium and titanium. The requirements for stabilization of carbon and nitrogen can be diminished for ferritic stainless steels where for instance the carbon content is very low, less than 0.01 weight %. However, this low carbon content causes requirements for the manufacturing process. The common AOD (Argon-Oxygen-Decarburization) producing technology for stainless steels is not any more practical and, therefore, more expensive producing methods shall be used, such 15 as the VOD (Vacuum-Oxygen-Decarburization) producing technology.

BACKGROUND OF THE INVENTION

The EP patent 936280 relates to a titanium and niobium stabilized ferritic stainless steel having the composition in weight % less than 0.025% carbon, 0.2-0.7% silicon, 0.1-1.0% manganese, 17-21% chromium, 0.07-0.4% nickel, 1.0-1.25% molybdenum, less 20 than 0.025% nitrogen, 0.1-0.2% titanium, 0.2-0.35% niobium, 0.045-0.060% boron, 0.02-0.04% (REM+hafnium), the rest being iron and inevitable impurities. According to this EP patent 936280 copper and molybdenum have a beneficial effect on the resistance to general and localised corrosion and the rare earth metals (REM) globulise the sulphides, thus improving ductility and formability. However, molybdenum and REM are expensive elements that make the manufacturing of the steel expensive.

The EP patent 1818422 describes a niobium stabilized ferritic stainless steel having among others less than 0.03 weight % carbon, 18-22 weight % chromium, less than 0.03 weight % nitrogen and 0.2-1.0 weight % niobium. In accordance with this EP patent the stabilization of carbon and nitrogen is carried out using only niobium.

The U.S. Pat. No. 7,056,398 describes a ultra-low-carbon-based ferritic stainless steel including in weight % less than 0.01% carbon, less than 1.0% silicon, less than 1.5% manganese, 11-23% chromium, less than 1.0% aluminium, less than 0.04% nitrogen, 0.0005-0.01% boron, less than 0.3% vanadium, less than 0.8% niobium, less than 1.0% titanium, wherein $18 \leq Nb/(C+N)+2(Ti/(C+N) \leq 60$. During the steel making process carbon is removed as much as possible and the solid-solution carbon is fixed as carbides by titanium and niobium. In the steel of the U.S. Pat. No. 7,056,398 a portion of titanium is replaced with vanadium and vanadium is added in combination with boron to improve toughness. Further, boron forms boron nitride (BN) which prevents the precipitation of titanium nitride further deteriorating the toughness of the steel. The steel of this U.S. Pat. No. 7,056,398 is concentrated on improving brittle resistance at the expense of corrosion resistance and recommends to use a protective over coating.

The EP patent application 2163658 describes a ferritic stainless steel with sulfate corrosion resistance containing less than 0.02% carbon, 0.05-0.8% silicon, less than 0.5% manganese, 20-24% chromium, less than 0.5% nickel, 0.3-0.8% copper, less than 0.02% nitrogen, 0.20-0.55% niobium, less than 0.1% aluminium and the balance being iron and inevitable impurities. In this ferritic stainless only niobium is used in the stabilization of carbon and nitrogen.

The EP patent application 2182085 relates to a ferritic stainless steel having a superior punching workability without generating burrs. The steel contains in weight % 0.003-0.012% carbon, less than 0.13% silicon, less than 0.25% manganese 20.5-23.5% chromium, less than 0.5% nickel, 0.3-0.6% copper, 0.003-0.012% nitrogen, 0.3-0.5% niobium, 0.05-0.15% titanium, less than 0.06% aluminium, the rest being iron and inevitable impurities. Further, the ratio Nb/Ti contained in a NbTi complex carbonitride present in ferrite crystal grain boundaries is in the range of 1 to 10. In addition, the ferritic stainless steel of this EP patent application 2182085 comprises less than 0.001% boron, less than 0.1% molybdenum, less than 0.05% vanadium and less than 0.01% calcium. It is also said that when the carbon content is more than 0.012% the generation of chromium carbide cannot be suppressed and the corrosion resistance is degraded, and that when more than 0.05% vanadium is added steel is hardened and, as a result, workability is degraded.

A ferritic stainless steel with good corrosion resistance is also described in the US patent application 2009056838 with the composition containing less than 0.03% carbon, less than 1.0% silicon, less than 0.5% manganese, 20.5-22.5% chromium, less than 1.0% nickel, 0.3-0.8% copper, less than 0.03% nitrogen, less than 0.1% aluminium, less than 0.01% niobium, ($4x(C+N)$ %<titanium <0.35%), (C+N) less than 0.05% and the balance being iron and inevitable impurities. In accordance with this US patent application 2009056838 niobium is not used, because niobium increases the recrystallization temperature, causing insufficient annealing in the high speed annealing line of a cold-rolled sheet. On the contrary, titanium is an essential element to be added for increasing pitting potential and thus improving corrosion resistance. Vanadium has an effect of preventing occurrence of intergranular corrosion in welding area. Therefore, vanadium is optionally added at the range of 0.01-0.5%.

The WO publication 2010016014 describes a ferritic stainless steel having excellent resistance to hydrogen embrittlement and stress corrosion cracking. The steel contains less than 0.015% carbon, less than 1.0% silicon, less than 1.0% manganese, 20-25% chromium, less than 0.5% nickel, less than 0.5% molybdenum, less than 0.5% copper, less than 0.015% nitrogen, less than 0.05% aluminium, less than 0.25% niobium, less than 0.25% titanium, and further less than 0.20% expensive element, tantalium, the balance being iron and inevitable impurities. The addition of high contents of niobium and/or tantalium causes strengthening of the crystalline structure and, therefore, the sum (Ti+Nb+Ta) is comprised in the range 0.2-0.5%. Further, for preventing hydrogen embrittlement the ratio (Nb+½Ta)/Ti is necessary to be at the range of 1-2.

The WO publication 2012046879 relates to a ferritic stainless steel to be used for a separator of a proton-exchange membrane fuel cell. A passivation film is formed on the surface of the stainless steel by immersing the stainless steel in a solution containing mainly hydrofluoric acid or a liquid mixture of hydrofluoric acid and nitric acid. The ferritic stainless steel contains carbon, silicon, manganese, aluminium, nitrogen, chromium and molybdenum in addition to iron as the necessary alloying elements. All other alloying elements described in the reference WO 2012046879 are optional. As described in the examples of this WO publication the ferritic stainless steel having a low carbon content is produced by vacuum smelting, which is a very expensive manufacturing method.

BRIEF SUMMARY OF THE INVENTION

The object of the present invention is to eliminate some drawbacks of the prior art and to achieve a ferritic stainless steel having good corrosion resistance and good sheet forming properties, which steel is stabilized by niobium, titanium and vanadium and is produced using AOD (Argon-Oxygen-Decarburization) technology. The essential features of the present invention are enlisted in the appended claims.

BRIEF DESCRIPTION OF THE SEVERAL VIEWS OF THE DRAWINGS

None.

DETAILED DESCRIPTION OF THE INVENTION

The chemical composition of a ferritic stainless steel according to the invention consists of in weight % less than 0.035% carbon (C), less than 1.0% silicon (Si), less than 0.8% manganese (Mn), 20-24% chromium (Cr), less than 0.8% nickel (Ni), less than 0.5% molybdenum (Mo), less than 0.8% copper (Cu), less than 0.05% nitrogen (N), less than 0.8% titanium (Ti), less than 0.8% niobium (Nb), less than 0.5% vanadium (V), aluminium less than 0.04% the rest being iron and evitable impurities occupying in stainless steels, in such conditions that the sum of (C+N) is less than 0.06% and the ratio (Ti+Nb)/(C+N) is higher or equal to 8, and less than 40, at least less than 25 and the ratio (Ti+0.515*Nb+0.940*V)/(C+0.858*N) is higher or equal to 6, and less than 40, at least less than 20. The ferritic stainless steel according to the invention is advantageously produced using AOD (Argon-Oxygen-Decarburization) technology.

The effects and the content in weight %, if nothing else mentioned, of each alloying element are discussed in the following:

Carbon (C) decreases elongation and r-value and, preferably, carbon is removed as much as possible during the steel making process. The solid-solution carbon is fixed as carbides by titanium, niobium and vanadium as described below. The carbon content is limited to 0.035%, preferably to 0.03%, but having at least of 0.003% carbon.

Silicon (Si) is used to reduce chromium from slag back to melt. Some silicon remainders in steel are necessary to make sure that reduction is done well. Therefore, the silicon content is less than 1.0%, but at least 0.05%, preferably 0.05-0.7%.

Manganese (Mn) degrades the corrosion resistance of ferritic stainless steel by forming manganese sulphides. With low sulphur (S) content the manganese content is less than 0.8%, preferable less than 0.65%, but at least 0.10%. The more preferable range is 0.10-0.65% manganese.

Chromium (Cr) enhances oxidation resistance and corrosion resistance. In order to achieve corrosion resistance comparable to steel grade EN 1.4301 chromium content must be 20-24%, preferably 20-21.5%.

Nickel (Ni) is an element favourably contributing to the improvement of toughness, but nickel has sensitivity to stress corrosion cracking (SCC). In order to consider these effects the nickel content is less than 0.8%, preferably less than 0.5% so that the nickel content is at least 0.05%.

Molybdenum (Mo) enhances corrosion resistance but reduces elongation to fracture. The molybdenum content is less than 0.5%, preferably less than 0.2%, but at least of 0.003%.

Copper (Cu) improves corrosion resistance in acidic solutions, but high copper content can be harmful. The copper content is thus less than 0.8%, preferably less than 0.5%, but at least 0.2%.

Nitrogen (N) reduces elongation to fracture. The nitrogen content is less than 0.05%, preferably less than 0.03%, but at least 0.003%.

Aluminium (Al) is used to remove oxygen from melt. The aluminium content is less than 0.04%.

Titanium (Ti) is very useful because it forms titanium nitrides with nitrogen at very high temperatures. Titanium nitrides prevent grain growth during annealing and welding. The titanium content is less than 0.8%, but at least 0.05%, preferably 0.05-0.40%.

Niobium (Nb) is used to some extent to bind carbon to niobium carbides. With niobium the recrystallization temperature can be controlled. Niobium is most expensive elements of chosen stabilization elements titanium, vanadium and niobium. The niobium content is less than 0.8%, but at least 0.05%, preferably 0.05-0.40%.

Vanadium (V) forms carbides and nitrides at lower temperatures. These precipitations are small and major part of them is usually inside grains. Amount of vanadium needed to carbon stabilization is only about half of amount of niobium needed to same carbon stabilization. This is because vanadium atomic weight is only about a half of niobium atomic weight. Because vanadium is cheaper than niobium then vanadium is an economic choice. Vanadium also improves toughness of steel. The vanadium content is less than 0.5%, but at least 0.03% preferably 0.03-0.20%.

Using all these three stabilization elements, titanium, niobium and vanadium in the ferritic stainless steel according to the invention, it is possible to achieve atomic lattice, which is practically interstitially free. That means that essentially all carbon and nitrogen atoms are bound with stabilization elements.

Several stainless steel alloys were prepared for testing the ferritic stainless steel of the invention. During the preparation every alloy was melted, cast and hot-rolled. The hot-rolled plate was further annealed and pickled before cold-rolling. Then the cold-rolled sheet at the final thickness was again annealed and pickled. The table 1 further contains the chemical compositions of the reference materials EN 1.4301 and 1.4404.

TABLE 1

Chemical compositions

| Alloy | C | Si | Mn | P | S | Cr | Ni | Mo | Ti | Nb | Cu | V | Al | N |
|---|---|---|---|---|---|---|---|---|---|---|---|---|---|---|
| A | 0.014 | 0.31 | 0.34 | 0.006 | 0.004 | 21.0 | 0.21 | <0.01 | 0.26 | 0.22 | 0.41 | 0.01 | 0.010 | 0.019 |
| B | 0.021 | 0.46 | 0.29 | 0.005 | 0.003 | 20.9 | 0.20 | <0.01 | 0.21 | 0.23 | 0.41 | 0.01 | 0.011 | 0.023 |
| C | 0.022 | 0.46 | 0.51 | 0.006 | 0.004 | 21.1 | 0.20 | <0.01 | 0.32 | 0.12 | 0.42 | 0.01 | 0.016 | 0.019 |
| D | 0.021 | 0.47 | 0.31 | 0.006 | 0.003 | 20.9 | 0.20 | <0.01 | 0.11 | 0.34 | 0.42 | 0.01 | 0.010 | 0.024 |
| E | 0.035 | 0.48 | 0.31 | 0.005 | 0.004 | 21.0 | 0.20 | <0.01 | 0.20 | <0.01 | 0.42 | 0.13 | 0.010 | 0.023 |
| F | 0.021 | 0.45 | 0.31 | 0.005 | 0.003 | 21.0 | 0.20 | <0.01 | 0.16 | <0.01 | 0.42 | 0.12 | 0.011 | 0.024 |
| G | 0.024 | 0.48 | 0.52 | 0.006 | 0.004 | 21.0 | 0.20 | <0.01 | 0.02 | 0.11 | 0.41 | 0.15 | 0.040 | 0.024 |
| H | 0.019 | 0.60 | 0.35 | 0.040 | 0.003 | 20.8 | 0.21 | 0.02 | 0.15 | 0.25 | 0.33 | 0.07 | 0.012 | 0.024 |
| I | 0.021 | 0.41 | 0.38 | 0.005 | 0.004 | 20.9 | 0.20 | <0.01 | 0.08 | 0.41 | 0.40 | 0.08 | 0.050 | 0.017 |
| J | 0.022 | 0.43 | 0.40 | 0.006 | 0.003 | 21.1 | 0.80 | <0.01 | 0.07 | 0.38 | 0.42 | 0.21 | 0.046 | 0.021 |
| K | 0.023 | 0.44 | 0.32 | 0.006 | 0.003 | 21.0 | 0.20 | <0.01 | 0.09 | 0.25 | 0.42 | 0.31 | 0.019 | 0.020 |
| L | 0.019 | 0.45 | 0.38 | 0.032 | — | 20.8 | 0.23 | 0.02 | 0.12 | 0.25 | 0.38 | 0.07 | 0.010 | 0.023 |
| EN 1.4301 | 0.04 | 0.4 | 1.4 | 0.03 | 0.001 | 18.2 | 8.1 | 0.2 | 0.01 | 0 | 0.4 | 0 | 0.002 | 0.04 |
| EN 1.4404 | 0.02 | 0.5 | 1.7 | 0.03 | 0.001 | 17.0 | 10.1 | 2.0 | 0.01 | 0 | 0.4 | 0 | 0.002 | 0.04 |

From the table 1 it is seen that the alloys A, B, C and D are double stabilized with titanium and niobium. The alloys A and B have essentially equal amount of titanium and niobium. The alloy C has more titanium than niobium, while the alloy D has more niobium than titanium. The alloys E, F, G and H contain also vanadium in addition to titanium and niobium, the alloys E and F having only a small amount of niobium and the alloy G having only a small content of titanium. The alloys triple stabilized with titanium, niobium and vanadium in accordance with the invention are the alloys H-L.

As corrosion resistance is the most important property of stainless steel, the pitting corrosion potential of all the alloys listed in the table 1 was determined potentiodynamically. The alloys were wet ground with 320 mesh and allowed to repassivate in air at ambient temperature for at least 24 hours. The pitting potential measurements were done in naturally aerated aqueous 1.2 wt-% NaCl-solution (0.7 wt-15% Cl−, 0.2 M NaCl) at room temperature of about 22° C. The polarization curves were recorded at 20 mV/min using crevice-free flushed-port cells (Avesta cells as described in ASTM G150) with an electrochemically active area of about 1 $cm^2$. Platinum foils served as counter electrodes. KCl saturated calomel electrodes (SCE) were used as reference electrodes. The average value of six breakthrough pitting potential measurements for each alloy was calculated and is listed in table 2.

In order to verify that the stabilization against intergranular corrosion was successful, the alloys were submitted to a Strauss test according to EN ISO 3651-2:1998-08: Determination of resistance to intergranular corrosion of stainless steels—Part 2: Ferritic, austenitic and ferritic-austenitic (duplex) stainless steels—Corrosion test in media containing sulfuric acid. The results of these tests are presented in the table 2.

The table 2 also contains the respective results for the reference materials EN 1.4301 and 1.4404.

TABLE 2

Pitting potential and sensitization

| Alloy | Corrosion potential, mV | Sensitization |
|---|---|---|
| A | 480 | no |
| B | 476 | no |
| C | 487 | no |
| D | 459 | no |
| E | 576 | no |

TABLE 2-continued

Pitting potential and sensitization

| Alloy | Corrosion potential, mV | Sensitization |
|---|---|---|
| F | 620 | no |
| G | 223 | yes |
| H | 645 | no |
| I | 524 | no |
| J | 566 | no |
| K | 567 | no |
| L | 672 | no |
| Ref. EN 1.4301 | 451 | no |
| Ref. EN 1.4404 | 550 | no |

The results for the corrosion potential in the table 2 show that the ferritic stainless steel of the invention has a better pitting corrosion resistance than the reference steels EN 1.4301 and EN 1.4404. Further, there is no sensitization for the alloys in accordance with the invention. The alloy G is outside of this invention, because the alloy G does not fulfil corrosion requirements of this invention. The alloy G is understabilized.

The yield strength $R_{p0,2}$, the tensile strength $R_m$ as well as the elongation to fracture ($A_{50}$) were determined for the ferritic stainless steel of the invention in the mechanical tests for the alloys of the table 1. The results are presented in the table 3:

TABLE 3

Results for mechanical tests

| Alloy | Rp0.2 $N/mm^2$ | Rm $N/mm^2$ | Elongation ($A_{50}$) % |
|---|---|---|---|
| A | 352 | 490 | 27 |
| B | 313 | 475 | 28 |

TABLE 3-continued

| Results for mechanical tests | | | |
|---|---|---|---|
| Alloy | Rp0.2 N/mm$^2$ | Rm N/mm$^2$ | Elongation ($A_{50}$) % |
| C | 319 | 473 | 30 |
| D | 316 | 485 | 28 |
| E | 358 | 488 | 28 |
| F | 365 | 481 | 30 |
| H | 350 | 515 | 31 |
| I | 334 | 498 | 28 |
| J | 361 | 509 | 26 |
| K | 324 | 492 | 29 |
| L | 332 | 485 | 32 |
| Ref. EN 1.4301 | 240 | 540 | >45 |

The results in the table 3 show that the alloys H-L having the stabilization with niobium, titanium and vanadium according to the invention have the better values within the tested alloys for tested mechanical properties than the alloys A-F, which are not in accordance with the invention. This is shown for instance when the tensile strength is combined with the elongation to fracture. Further, the test results of the table 3 show, that the tensile strength and the elongation to fracture of the reference material EN 1.4301 are higher than the representative values for the ferritic stainless steel. The reason is based on different atomic lattice type. The reference steel lattice is called face centred cubic (FCC) lattice and ferritic stainless lattice is called body centred cubic (BCC). FCC lattice has "always" better elongation than BCC lattice.

The ferritic stainless steel in accordance with the invention was also tested for the determination of values in sheet forming properties which are very important in many thin sheet applications. For those sheet forming properties there were done sheet forming simulation test for a uniform elongation ($A_g$) and r-value. The uniform elongation correlates with the sheet stretching capabilities, and the r-value correlates with the deep drawing capabilities. Uniform elongation and r-values were measured with tensile test. The results of the tests are presented in the table 4:

TABLE 4

| Sheet forming properties | | |
|---|---|---|
| Alloy | uniform elongation ($A_g$) % | r-value |
| A | 18.9 | 1.82 |
| B | 19.0 | 1.75 |
| C | 18.5 | 1.75 |
| D | 18.6 | 2.05 |
| E | 18.4 | 2.09 |
| F | 18.6 | 1.91 |
| H | 19.1 | 2.44 |
| I | 18.8 | 1.82 |
| J | 17.0 | 1.81 |
| K | 18.0 | 1.89 |
| L | 19.1 | 2.55 |
| Ref. EN 1.4301 | >40 | 1.1 |

The results in the table 4 show, that the alloys H and L have the longest uniform elongation and the highest r-value, when these alloys are compared with the other test alloys. Even though the reference material EN 1.4301 has a better uniform elongation than the tested alloys, EN 1.4301 has a much weaker r-value than all the tested alloys.

When using niobium, titanium and vanadium in the stabilization of the interstitial elements carbon and nitrogen in the ferritic stainless steel of the invention, the compounds which are generated during the stabilization, are such as titanium carbide (TiC), titanium nitride (TiN), niobium carbide (NbC), niobium nitride (NbN), vanadium carbide (VC) and vanadium nitride (VN). In this stabilization it is used a simple formula to evaluate the amount and the effect of stabilization as well as the role of the different stabilization elements.

The connection between the stabilization elements titanium, niobium and vanadium is defined by a formula (1) for a stabilization equivalent ($Ti_{eq}$) where the content of each element is in weight %:

$$Ti_{eq}=Ti+0.515*Nb+0.940*V \quad (1).$$

Respectively, the connection between of the interstitial elements carbon and nitrogen is defined by a formula (2) for an interstitial equivalent ($C_{eq}$) where the contents of carbon and nitrogen are in weight %:

$$C_{eq}=C+0.858*N \quad (2).$$

The ratio $Ti_{eq}/C_{eq}$ is used as one factor for determining the disposition for sensitization, and the ratio $Ti_{eq}/C_{eq}$ is higher or equal to 6 and the ratio (Ti+Nb)/(C+N) higher or equal 15 to 8 for the ferritic stainless steel of the invention in order to avoid the sensitization.

The values for the ratio $Ti_{eq}/C_{eq}$ for the alloys A to H as well as for the ratio (Ti+Nb)/(C+N) are calculated in the table 5.

TABLE 5

| Values for $Ti_{eq}/C_{eq}$ and (Ti + Nb)/(C + N) | | |
|---|---|---|
| Alloy | $Ti_{eq}/C_{eq}$ | (Ti + Nb)/(C + N) |
| A | 12.8 | 14.5 |
| B | 8.4 | 10.0 |
| C | 10.3 | 10.7 |
| D | 7.0 | 10.0 |
| E | 6.0 | 3.6 |
| F | 6.8 | 3.8 |
| G | 4.9 | 2.7 |
| H | 8.8 | 9.3 |
| I | 10.3 | 12.9 |
| J | 11.5 | 10.4 |
| K | 12.6 | 8.0 |
| L | 8.1 | 8.7 |

The values of the table 5 show that the alloys H-L, the triple stabilized with niobium, titanium and vanadium in accordance with the invention, have favourable values for both the ratios $Ti_{eq}/C_{eq}$ and (Ti+Nb)/(C+N). Instead, for instance the alloy G, which was sensitized according to the table 2, has unfavourable values for both the ratios $Ti_{eq}/C_{eq}$ and (Ti+Nb)/(C+N).

SEQUENCE LISTING

Not Applicable.

The invention claimed is:

1. A triple stabilized ferritic stainless steel having corrosion and sheet forming properties, wherein the stainless steel consists of, in weight percentages, 0.020-0.035% carbon, 0.40-0.60% silicon, 0.32-0.8% manganese, 20-21.5% chromium, 0.05-0.8% nickel, 0.003-0.02% molybdenum, 0.2-0.8% copper, 0.003-0.05% nitrogen, less than 0.04 weight % aluminum, and triple stabilized with 0.05-0.8% titanium, 0.05-0.8% niobium, and 0.03-0.19% vanadium; and the sum C+N is less than 0.06%, the remainder being iron and inevitable impurities, that the ratio (Ti+Nb)/(C+N)

is higher or equal to 8, and less than 40, and a ratio $Ti_{eq}/C_{eq}$=(Ti+0.515*Nb+0.940*V)/(C+0.858*N) is higher or equal to 6, less than 40, and the stainless steel having:

an r-value within a range of 1.8-2.55; and a corrosion potential of 524-672 mV.

2. A triple stabilized ferritic stainless steel having corrosion and sheet forming properties, wherein the stainless steel consists of, in weight percentages, greater than 0.020-0.035% carbon, 0.40-0.60% silicon, 0.32-0.8% manganese, 20-21.5% chromium, 0.05-0.8% nickel, 0.003-0.02% molybdenum, 0.2-0.8% copper, 0.003-0.05% nitrogen, greater than 0.012-less than 0.04 weight % aluminum, and triple stabilized with 0.05-0.8% titanium, 0.05-0.8% niobium, and 0.03-0.19% vanadium; and the sum C+N less than 0.06%, the remainder being iron and inevitable impurities that the ratio (Ti+Nb)/(C+N) is higher or equal to 8, and less than 40, and a ratio $Ti_{eq}/C_{eq}$=(Ti+0.515*Nb+0.940*V)/(C+0.858*N) is higher or equal to 6, and less than 40, and the stainless steel having:

an r-value within a range of 1.8-2.55; and a corrosion potential of 524-672 mV.

3. The ferritic stainless steel, according to claim 1, characterized in that the manganese content is 0.32-0.65 weight %.

4. The ferritic stainless steel, according to claim 1, characterized in that the nickel content is 0.05-less than 0.5 weight %.

5. The ferritic stainless steel, according to claim 1, characterized in that the copper content is 0.2-less than 0.5 weight %.

6. The ferritic stainless steel, according to claim 1, characterized in that the nitrogen content is 0.003-less than 0.03 weight %.

7. The ferritic stainless steel, according to claim 1, characterized in that the titanium content is 0.05-0.40 weight %.

8. The ferritic stainless steel, according to claim 1, characterized in that the niobium content is 0.05-0.40 weight %.

9. The ferritic stainless steel, according to claim 1, characterized in that the ratio (Ti+Nb)/(C+N) is higher or equal to 8, and less than 25.

10. The ferritic stainless steel, according to claim 1, characterized in that the ratio $Ti_{eq}/C_{eq}$=(Ti+0.515*Nb+0.940*V)/(C+0.858*N) is higher or equal to 6, and less than 20.

11. The ferritic stainless steel, according to claim 1, characterized in that the stainless steel is produced using Argon-Oxygen-Decarburization technology.

12. The ferritic stainless steel, according to claim 2, characterized in that the stainless steel is produced using Argon-Oxygen-Decarburization technology.

* * * * *